US006773334B1

(12) United States Patent
Mallison

(10) Patent No.: US 6,773,334 B1
(45) **Date of Patent: *Aug. 10, 2004**

(54) DUST COLLECTION AND REMOVAL SYSTEM

(75) Inventor: Frank K. Mallison, Akron, OH (US)

(73) Assignee: Akron Special Machinery, Inc., Akron, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 859 days.

(21) Appl. No.: 08/968,534

(22) Filed: Nov. 12, 1997

(51) Int. Cl.[7] ..... B24B 1/00

(52) U.S. Cl. ..... 451/38; 451/246; 451/254; 451/456; 451/920

(58) Field of Search ..... 451/178, 242, 451/246, 254, 258, 456, 920, 451, 49, 38, 40

(56) References Cited

U.S. PATENT DOCUMENTS 4,525,955 A * 7/1985 Cothrell et al. ..... 451/456
5,047,089 A * 9/1991 Grant ..... 451/456
5,279,076 A 1/1994 Healy et al. ..... 51/273
5,594,972 A 1/1997 Iversen ..... 15/301

* cited by examiner

*Primary Examiner*—Eileen P. Morgan
(74) *Attorney, Agent, or Firm*—Renner, Kenner, Greive, Bobak, Taylor & Weber

(57) ABSTRACT

A dust collection and removal system for use in conjunction with a tire uniformity machine includes a grinding wheel shroud having a vacuum aperture therein. The vacuum aperture is connected to a vacuum source. An air nozzle is centrally mounted in the vacuum aperture. The air nozzle is connected to a source of pulsed air thereby allowing a blast of air to be directed at the tire surface during or immediately after grinding to dislodge dust particles adhered to the tire. The dislodged dust particles are then removed via the vacuum. A related method of collecting and removing dust includes mounting a vacuum hose adjacent to the grinding face, mounting an air nozzle in the center of the vacuum hose, directing a blast of air toward the tire surface via the nozzle, and removing and collecting the dislodged dust particles via the vacuum hose.

17 Claims, 4 Drawing Sheets

DUST COLLECTION AND REMOVAL SYSTEM

RELATED PATENT APPLICATIONS

None.

FIELD OF THE INVENTION

This invention relates generally to dust collection and removal systems and relates in particular to a dust collection and removal system to be used in conjunction with apparatus for improving tire uniformity during the manufacture of tires.

BACKGROUND OF THE INVENTION

Tire uniformity machines are well known in the art and the grinding of tires on such machines is also well known. Representative examples of tire uniformity machines may be seen in Beebe U.S. Pat. No. 4,805,125 and Cargould U.S. Pat. No. 5,029,467.

As part of the overall testing and inspection conducted on such machines, it is common to grind rubber from selected areas on the tire perimeter to bring the tire within the range of acceptable specifications. This is usually accomplished by advancing grinding stones into and out of contact with the tire. This operation is repeated until the high spots or non-specification peaks on the tire are eliminated and the tire is brought into the specified range.

A variety of sensors, non-contact probes and encoders are utilized with such machines for the purpose of locating areas of non-uniformity and also for properly positioning the grinders relative to the tire.

As a result of the grinding process, a great deal of dust is created. This resultant dust presents a number of problems in the tire inspection process. Dust is scattered throughout the operating area of the machine and frequently into the surrounding area. Accumulation of dust in the operating area of the machine tends to inhibit the operation of the requisite sensors, probes and encoders as these devices become covered and/or clogged by dust. Similarly, a portion of the dust resettles on the tire itself even becoming embedded in the tread thereof. This accumulation on the tire further inhibits operation of sensors, probes and encoders by interfering with the sensors' ability to accurately detect the true surface of the tire. Further, the resultant dust presents an environmental hazard particularly for workers in close proximity to the machine.

Consequently, efforts have been made in recent years to devise methods and systems for removing and collecting the dust created by such machines. The prior art is replete with methods for removing dust and detritus from work areas generally, such as during woodworking or machining operations.

An example of such a method and device is seen in Iversen U.S. Pat. No. 5,594,972 which discloses a system employing a funnel assembly mounted in proximity to a workpiece. The funnel assembly is provided with a vacuum assist in the form of a vacuum hose affixed to the funnel. Dust, sparks, and grindings enter the funnel and pass therethrough into the vacuum hose which transports the material to a disposal point such as a collection container.

The primary disadvantage of using such passive methods and devices with tire grinding machines is that the fine rubber dust produced is initially at a relatively high temperature due to the frictional grinding process. As a result, the dust becomes sticky and tends to adhere both to itself and to the tire surface. As the hot rubber dust begins to cool, it adheres even more securely to the tire. This phenomenon makes a purely vacuum-based system impractical inasmuch as the typical vacuum developed by such systems is insufficient to dislodge the rubber dust adhered to the tire surface. Accordingly, only a portion of dust is removed.

One effort to overcome the disadvantages of the aforementioned method is shown in Healy et al. U.S. Pat. No. 4,279,076 which discloses a dust collection apparatus specifically tailored for use with tire grinding machinery. The disclosed device comprises a brush which contacts the tire surface in the proximity of the grinding wheel. The brush includes a plurality of apertures interspersed within the bristles. These apertures communicate with a vacuum assist by way of a hollow arm upon which the brush is mounted. Accordingly, the brush acts to dislodge dust adhered to the tire surface which, ideally, is then removed via the vacuum.

In use, the aforementioned device may present a number of practical disadvantages in removing dust during tire grinding. Because the brush must contact the tire in order to be effective, it is located such that it is subject to damage in the event of a mischuck of the tire. Further, constant contact with the tire causes a great deal of wear, necessitating periodic replacement of the brush in order to be effective. It has also been found that the brush bristles do not always reach fully into deep treads. Consequently, a portion of dust is left unremoved having been pushed even deeper into the tread. Another disadvantage is that the vacuum apertures interspersed among the bristles of the brush tend to become clogged necessitating periodic cleaning or replacement. Since virtually all vehicle tires are now subject to processing in these machines on a continuous assembly line basis, any downtime is obviously undesirable in addition to the expense of replacing the brushes themselves.

It is, therefore, thought desirable to provide a means for removing and collecting dust resulting from the grinding of tires, which does not require contact with the tire, thereby eliminating the brush and its attendant disadvantages.

SUMMARY OF THE INVENTION

It is, therefore, a principal object of this invention to provide a dust removal and collection system which is effective to dislodge and remove the majority of dust produced during the tire grinding process from the tire surface and surrounding area without contacting the tire itself.

To that end, it has been found that a nozzle emitting a pulsed air blast can be provided on existing tire grinding machinery, in the proximity of the grinding wheels, to effectively dislodge dust adhered to the tire surface, even that which has become embedded in the tread of the tire.

It has also been found that a vacuum assist may be provided in conjunction with the aforementioned nozzle to remove and carry away the dislodged dust from the area of tire grinding. Further, it has been found that the aforementioned nozzle may be provided with means for adjustment so as to allow the pulsed air blast to be directed to a particular location, thereby optimizing removal and collection of dust particles.

Accordingly, production of an improved dust removal and collection system of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
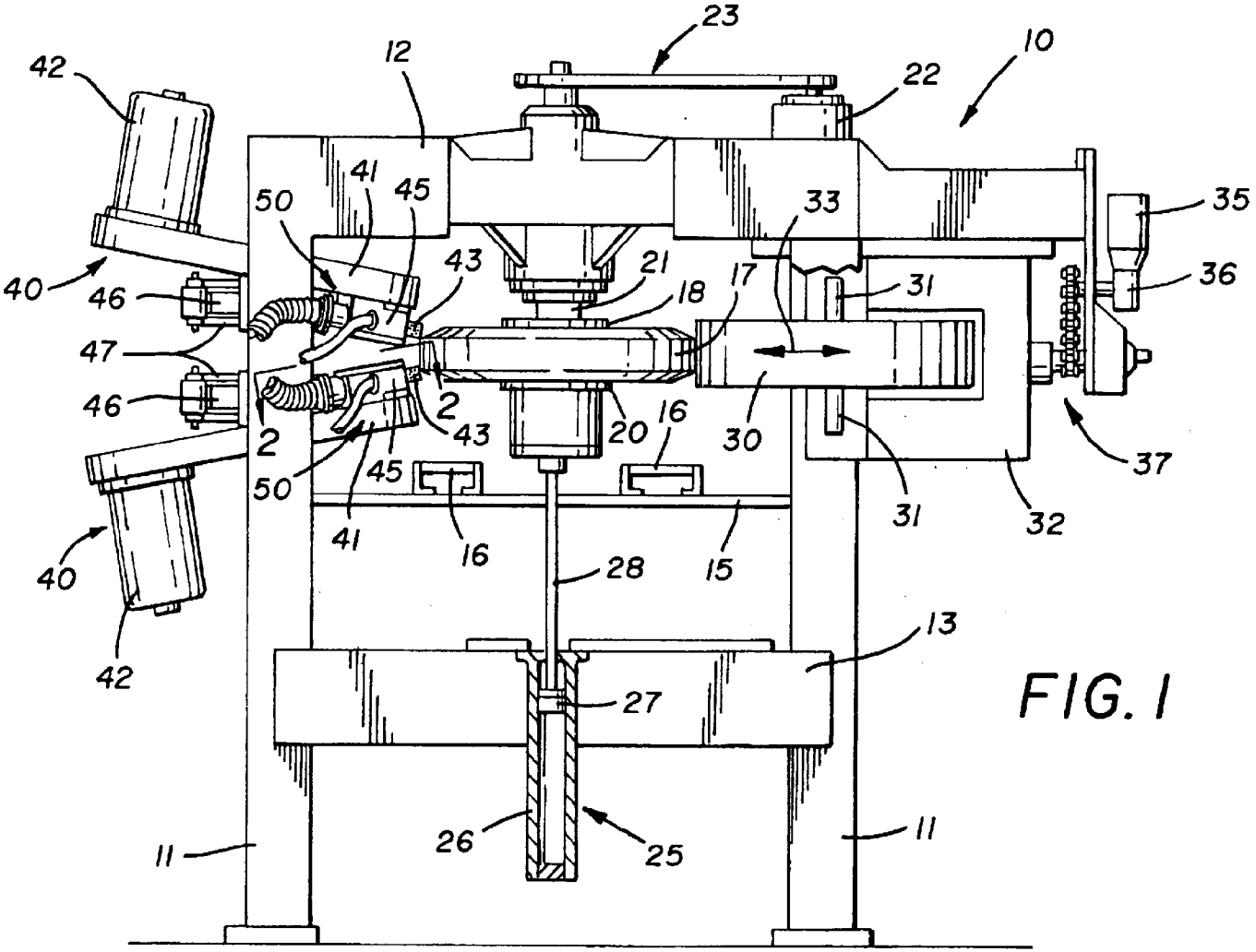
FIG. 1 is an elevational view of a tire uniformity machine incorporating the invention shown partially in section.

Referring first to FIG. 1 of the drawings, it will be noted that the tire uniformity machine, generally indicated by the numeral 10, is essentially conventional in construction. To that end, it includes a plurality of upright frame members 11, and top and bottom cross-frame members 12 and 13, respectively, forming a cube-shaped framework. Mounted on this framework is a conveyor 15 of a known type and which generally includes a plurality of conveyor rollers 16 which enable the tire 17 to be brought into position between the opposed upper and lower chucks 18 and 20, respectively, of the tire uniformity machine 10 and then removed from the framework following testing and grinding.

To that end, as is well known in the art, the upper chuck 18 is fixed while the lower chuck 20 is movable. The upper chuck 18 is secured to a spindle 21. This spindle can be rotated during operation of the device by means of the motor 22 and the chain drive assembly 23. This arrangement is well known in the art and will not be further discussed or described in detail herein.

The lower chuck 20 is movable toward and away from the upper chuck 18. To that end, it is associated with a hydraulic cylinder assembly 25 which includes a cylinder 26, a piston 27, and a piston rod 28. In that way, tires 17 can be brought into the framework on the conveyor 15, positioned between the upper and lower chucks 18 and 20, and the lower chuck 20 can be raised to close the two chucks and trap the tire.

A loadwheel 30 is also provided on the framework and is rotationally mounted on spindles 31 which are, in turn, mounted on a carriage 32 which can move radially inward and outward, toward and away from the tire 17 in the direction of arrow 33. To that end, a reversible motor 35 and gear reduction unit 36 are connected to a chain drive and screw arrangement generally indicated by the numeral 37. Thus, once the tire 17 has been chucked and inflated, the loadwheel 30 can be moved into engagement with it.

All of the structure thus far described is conventional and well known in the art and has, therefore, been essentially illustrated somewhat schematically.

FIG. 1 also illustrates a pair of grinding wheel assemblies 40, each of which generally include an arm 41 and a motor 42 operable to drive a grinding wheel 43, which is carried by a housing 45, when the wheel is moved into engagement with the periphery of the tire 17.

It should be appreciated that a hydraulic cylinder 46 is supported on one frame member 11 and attached to a second arm 47 which is mounted for pivotal movement on the opposing frame member 11. Thus, actuation of the cylinder 46 makes it possible to move the grinding wheel 43 into and out of contact with the tire 17 as required. As is well known in the art, actuation of the cylinder 46 may be controlled by way of logic provided by electronic sensors (not shown) designed to detect areas of non-conformity on the tire surface.

Figure 2:
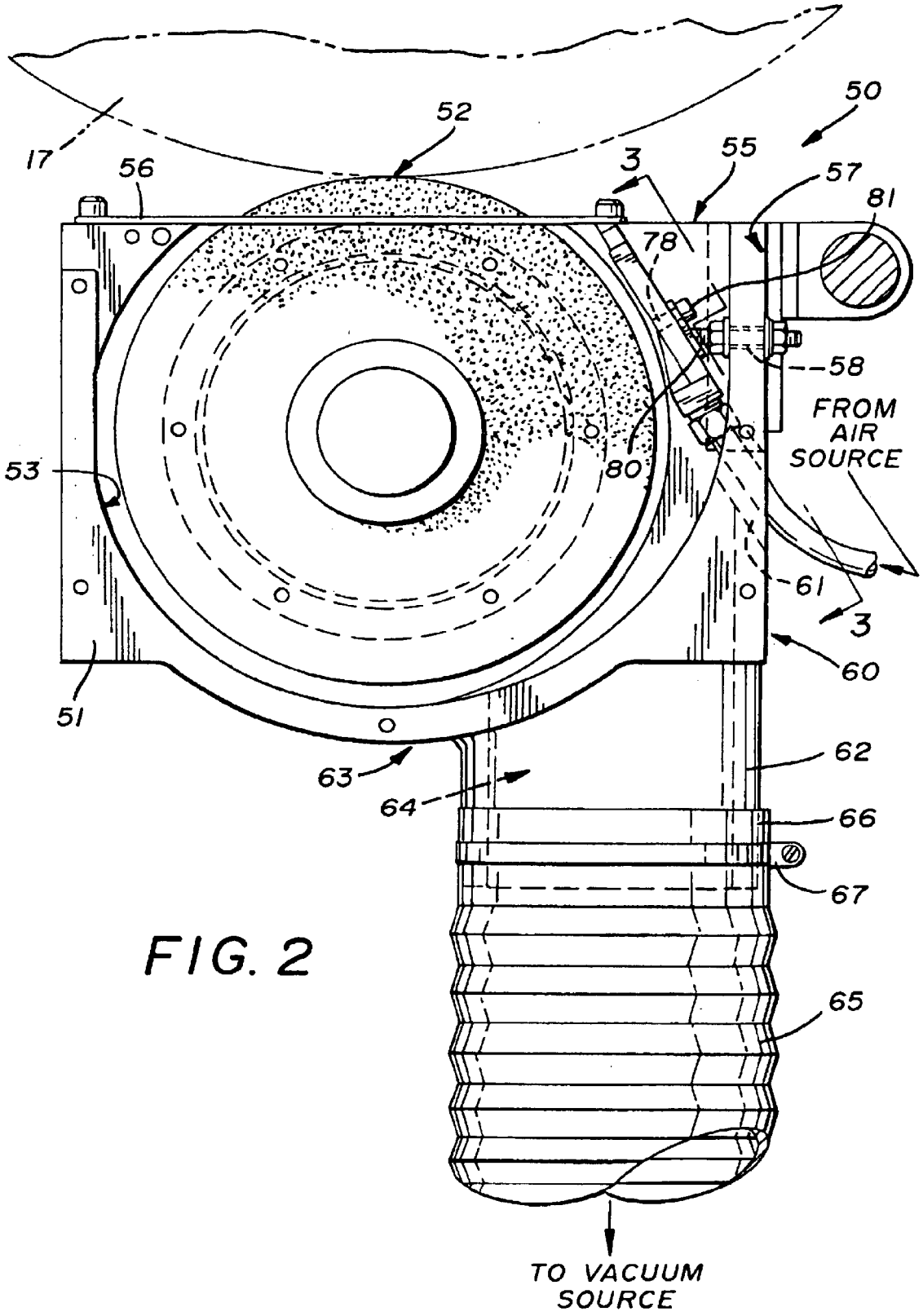
FIG. 2 is a cross-sectional view of a grinding wheel assembly of the machine of FIG. 1 taken along the line 2—2.

With continuing reference to FIG. 1, and also referring now to FIG. 2 of the drawings, it will be seen that the unique dust removal and collection means, designated generally by the numeral 50, includes a grinding wheel shroud 51 adapted to enclose all of the grinding wheel 43, except for a small portion comprising the exposed grinding face indicated at 52. Thus, the shroud 51 is of a generally U-shaped configuration having a generally annular interior wall 53. The interior wall 53 lies on a radius slightly larger than that of the grinding wheel 43 and thus serves to enclose the grinding wheel. As is apparent from the drawings, the shroud 51 is substantially open at its first side 55 allowing the grinding wheel 43 to extend therethrough in the area of the grinding face 52. A face plate 56 may be affixed to the first side 55 of the shroud 51 to further enclose the grinding wheel 43.

Figure 3:
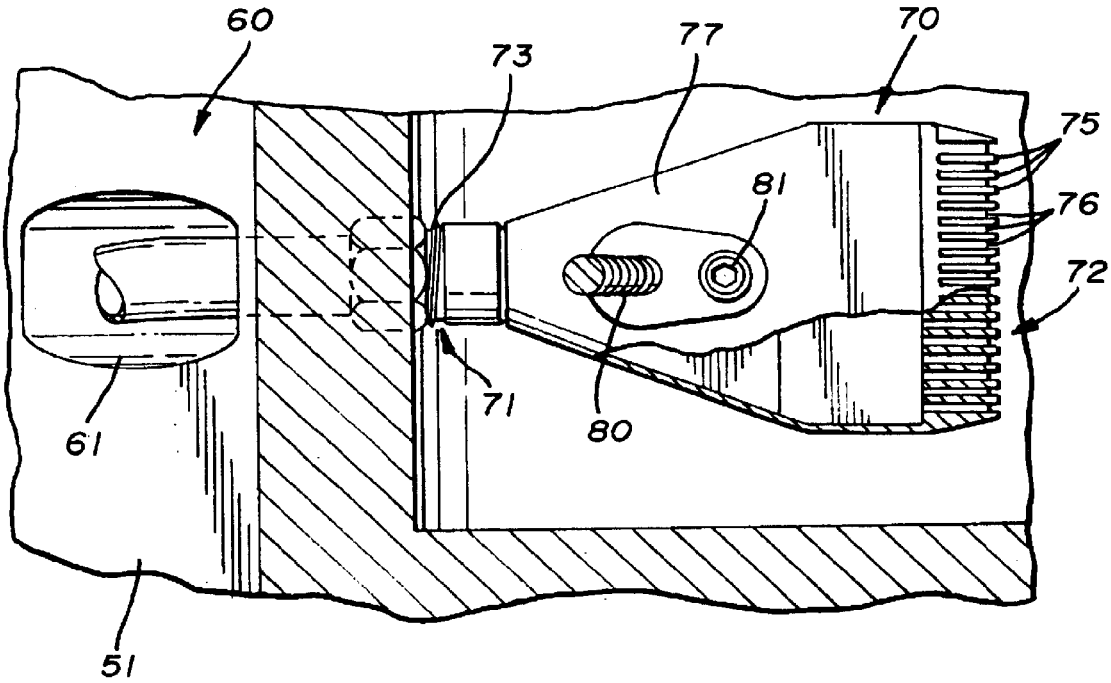
FIG. 3 is a cross-sectional view of the assembly of FIG. 2 taken substantially along the line 3—3.

As is perhaps best shown in FIGS. 2 and 3, a portion of the annular interior wall 53 of the shroud 51 is recessed to create a vertical nozzle mounting surface 57. The mounting surface 57 is provided with a nozzle mounting aperture 58 perpendicularly disposed in the second side 60 of the shroud 51. Similarly, an angular hose access aperture 61 is also provided in the second side 60.

The shroud 51 further includes an annular hose mounting surface 62 extending outwardly from the third side 63 thereof. The hose mounting surface 62 surrounds a vacuum aperture 64 which communicates with the interior of the shroud 51.

A flexible vacuum hose 65 of a conventional type, as is well known in art, matingly engages the hose mounting surface 52 and is clampingly affixed thereto at its first end 66 by way of a ring clamp 67. The second end (not shown) is similarly clampingly affixed to a vacuum source and collection point (not shown). Thus, the hose 65 operatively communicates between the shroud 51 and vacuum source so as to provide a vacuum assist at the grinding face 52.

As shown, a nozzle 70 is mounted in the recessed portion of the shroud interior at the mounting surface 57. The nozzle 70 includes first and second ends 71 and 72, respectively. At the first end 71, the nozzle is provided with a hose mating boss 73, while the second end 72 is provided with a plurality of fins 75 interspersed with a plurality of apertures 76. As should be apparent, the apertures 76 communicate, through the interior of the nozzle, with the hose mating boss 73. Accordingly, the first end 71 acts as an air inlet while the second end 72 acts as an air outlet. Further, it will be noted that the nozzle body 77 tapers outwardly while becoming more flat progressing from the first end 71 toward the second end 72.

It should be noted that the nozzle described herein is well known in the art and is described in detail here only to aid in the understanding of the invention which is not limited to the specific nozzle structure described, it being understood that a variety of nozzle designs will adapt equally well to the invention.

The nozzle 70 is provided with a threaded mounting boss 78 located at approximately the center of the nozzle body 77. A threaded mounting and adjustment stud 80 is affixed to the mounting boss 78 by way of a screw 81. The nozzle 70 is mounted in the shroud 51 by securing the mounting stud 80 in the mounting aperture 58 so that the first end 71 is disposed proximal to the hose aperture 61 and the second end 72 is disposed proximal to the grinding face 52. A suitable air hose 82 of a type well known in the art is affixed to the hose mating boss 73 of the nozzle by press fitting the first end 85 of the hose 82 over the hose mounting boss 73 so as to form a tight frictional fit. The hose 82 passes through the aperture 61 in the shroud and is connected at its second end (not shown) to a suitable air source (not shown).

Figure 4:
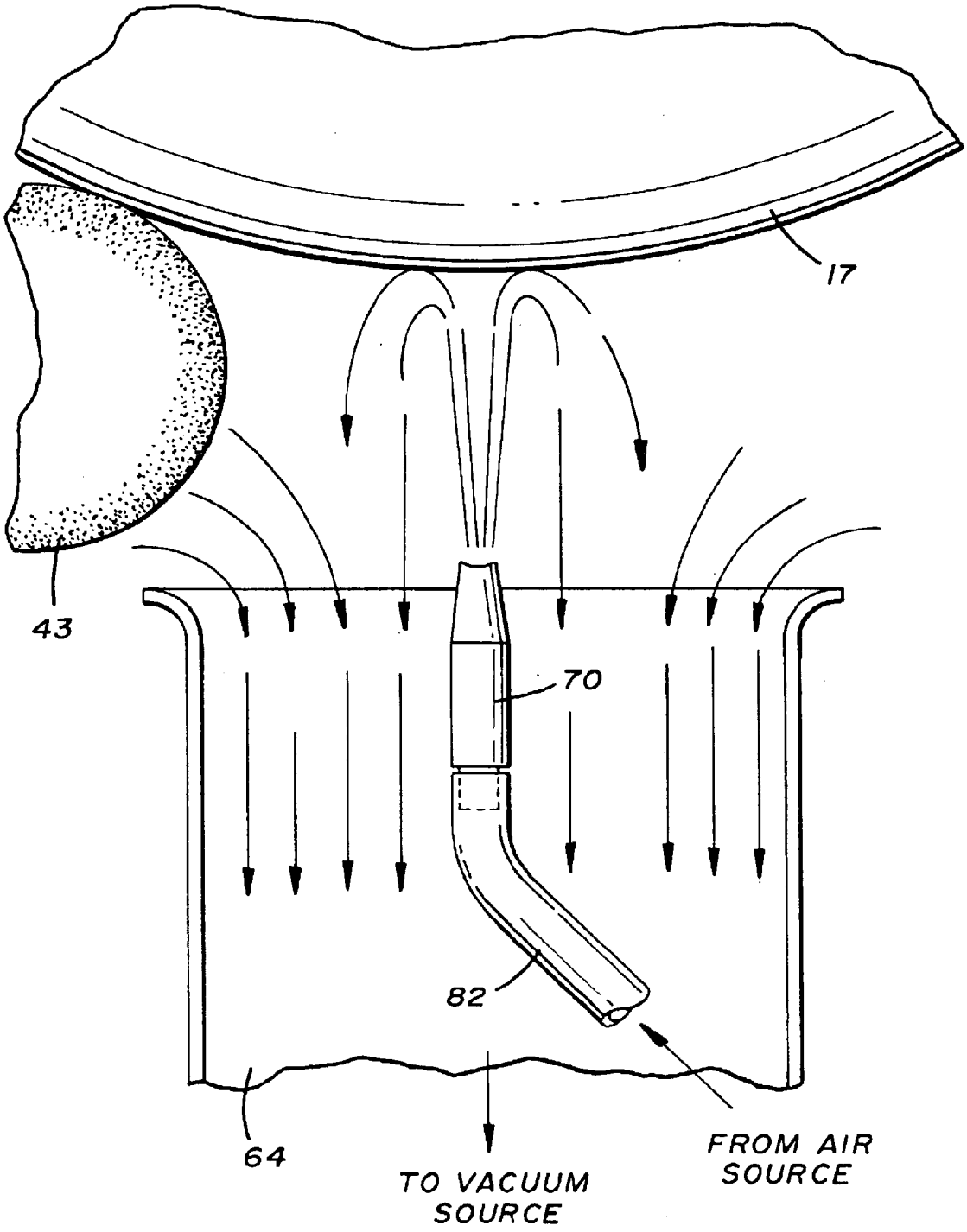
FIG. 4 is a schematic view of the invention showing the flow of air into the vacuum.

A unique aspect of the present invention is the placement of the nozzle 70 inside the shroud 51. Specifically, it can be seen in the drawings that the nozzle 70 is located in the center of the vacuum path such that the high-pressure air being emitted from the nozzle 70 is focused directly at the point of lowest pressure created by the vacuum. It has been found in practice that such precise placement of the nozzle 70 dramatically increases the ability of the vacuum to remove dust dislodged by the nozzle 70. The addition of a flow of high-pressure air at this area of lowest pressure actually serves to feed the air-starved vacuum. This is perhaps best illustrated with reference to FIG. 4 which attempts to depict schematically the flow of air out of the nozzle 70 and into the vacuum. As shown, the nozzle 70 is located in the center of the vacuum and as such air is being swept into the vacuum all around the nozzle 70. High-pressure air being omitted at the nozzle 70 is directed against the tire surface and serves to dislodge dust therefrom. As air strikes the tire, it is deflected away from the tire as indicated by the arrows and back toward the vacuum. Thus, the air being emitted by the nozzle actually serves to feed the vacuum at what would otherwise be the area of lowest pressure. Further, substantially all of the dust dislodged from the tire surface is immediately swept into the vacuum inasmuch as the nozzle is located in an area of low relative pressure created by the vacuum. It will thus be appreciated that the air being swept into the vacuum all around the nozzle 70 forms a virtual air curtain around the nozzle and more importantly around the point where high-pressure air strikes and is deflected by the tire surface.

Thus, a stream or blast of high-pressure air may be directed against the tire surface at the time of grinding or immediately following so as to dislodge dust from the tire surface and from within the treads. The dislodged dust may then be carried away via the vacuum hose to an appropriate collection point. Accordingly, the system described above serves to remove a substantial portion of the dust created during tire grinding without contacting the tire. The invention also aids in the grinding process by creating a cooling effect at the grinding point.

In practice, a number of ways have been found to optimize performance of the above-described invention. For example, it has been found that pulsation of air at the nozzle outlet has several beneficial effects. For example, the use of pulsed air, as opposed to a steady stream, helps to reduce air consumption and, therefore, operating costs. Further, the interval between pulses improves vacuum performance. Similarly, pulsing air tends to create a vortex effect to further induce air flow so as to assist the vacuum.

It should be noted that the effects of the nozzle and vacuum may be optimized by utilizing the ability to adjust the nozzle position at the mounting stud. To that end, the nozzle may be pivoted up and down by loosening the mounting screw 81. Similarly, the lateral position of the nozzle may be adjusted by loosening the nuts on the mounting stud and repositioning the nozzle.

Likewise, it will be appreciated that the invention may further be optimized by utilizing more than one nozzle. As such, the nozzles could be actuated sequentially or simultaneously, as desired, to create an appropriate air flow pattern. Similarly, the pulsation of air could be controlled to optimize dust removal for tires of different tread patterns or tread depth.

While a full and complete description of the invention has been set forth in accordance with the dictates of the patent statutes, it should be understood that modifications can be resorted to without departing from the spirit hereof or the scope of the appended claims.

Thus, while a specific dust removal and collection means has been referred to, it will be apparent that other similar apparatus having comparable operational characteristics can be employed and the apparatus specifically identified is identified by way of illustration only.

What is claimed is:

1. In a machine having grinding wheels for selectively engaging the periphery of a tire, a dust collection and removal apparatus comprising:

a) shroud means for housing the grinding wheels;

b) vacuum means for collecting and removing dislodged dust from the tire surface and surrounding area, said vacuum means being connected to said shroud means and generating a vacuum flow which defines a vacuum flow path;

c) nozzle means for directing a blast of air against the tire surface to dislodge dust adhered to the tire, said nozzle means being centered within the flow path generated by said vacuum means; and d) mounting means for mounting and adjusting said nozzle means within said shroud means.

2. The dust collection and removal apparatus of claim 1 wherein said shroud means comprises a generally U-shaped member having an annular interior wall.

3. The dust collection and removal apparatus of claim 2 wherein said shroud means further comprises a mounting recess disposed in said annular interior wall.

4. The dust collection and removal apparatus of claim 3 wherein said shroud means further comprises a mounting aperture disposed in said annular interior wall adjacent to said mounting recess, and a hose access aperture also disposed in said annular interior wall.

5. The dust collection and removal apparatus of claim 4 wherein said shroud means further comprises a vacuum port in said annular interior wall.

6. The dust collection and removal apparatus of claim 5 wherein said nozzle means comprises an air inlet and at least one aperture forming an air outlet.

7. The dust collection and removal apparatus of claim 6 wherein said nozzle means further comprises an air hose connected to said air inlet and further communicating with an air source.

8. The dust collection and removal apparatus of claim 7 wherein said vacuum means comprises a hose communicating between said vacuum port and a vacuum source.

9. The dust collection and removal apparatus of claim 8 wherein said mounting means is a stud plate connected to said nozzle and disposed within said mounting aperture.

10. The dust collection and removal apparatus of claim 1 wherein said vacuum means comprises a hose communicating between said shroud means and a vacuum source.

11. The dust collection and removal apparatus of claim 10 wherein said hose further communicates with a collection point.

12. The dust collection and removal apparatus of claim 1 wherein said mounting means comprises a stud plate connected to said nozzle means and further connected to said shroud means.

13. The dust collection and removal apparatus of claim 1 wherein said nozzle means comprises an air inlet and at least one aperture forming an air outlet.

14. The dust collection and removal apparatus of claim 13 wherein said nozzle means further comprises an air hose connected to said air inlet and further communicating with an air source.

15. In a tire uniformity machine having grinding wheels for selectively engaging the periphery of a tire to improve tire uniformity, a dust collection and removal apparatus comprising:

a) a generally U-shaped shroud member having an annular interior wall, a mounting recess disposed in said annular interior wall, a mounting aperture disposed in said annular interior wall adjacent to said recess, and a vacuum port also disposed in said annular interior wall;

b) a vacuum hose communicating between said vacuum port and a vacuum source generating a vacuum flow which defines a vacuum flow path;

c) an air nozzle having an air inlet and at least one aperture forming an air outlet, said air nozzle being mounted to said shroud opposite said vacuum port and substantially centered in said flow path by way of a stud plate connected to said air nozzle and further connected to said mounting aperture such that said air nozzle is disposed in said flow path of said vacuum flow; and d) an air hose connected to said air inlet of said air nozzle and further communicating with an air source.

16. A method of collecting and removing dust from a tire uniformity machine having grinding wheels for selectively engaging the periphery of a tire to improve tire uniformity, comprising the steps of:

a) mounting at least one vacuum hose adjacent to the grinding wheel;

b) mounting at least one air nozzle in the center of the vacuum flow path generated by said at least one vacuum hose;

c) directing a blast of air from said at least one air nozzle toward the tire to dislodge dust therefrom; and d) collecting and removing the dislodged dust along said vacuum path through said at least one vacuum hose.

17. The method of claim 16 further characterized by pulsing said blast of air from said at least one air nozzle.

* * * * *